US006838169B2

(12) United States Patent
Obeng

(10) Patent No.: US 6,838,169 B2
(45) Date of Patent: Jan. 4, 2005

(54) POLISHING PAD RESISTANT TO DELAMINATION

(75) Inventor: Yaw S. Obeng, Orlando, FL (US)

(73) Assignee: PsiloQuest, Inc., Orlando, FL (US)

( * ) Notice: Subject to any disclaimer, the term of this patent is extended or adjusted under 35 U.S.C. 154(b) by 62 days.

(21) Appl. No.: 10/401,239

(22) Filed: Mar. 27, 2003

(65) Prior Publication Data

US 2004/0146712 A1 Jul. 29, 2004

Related U.S. Application Data

(63) Continuation-in-part of application No. 10/241,074, filed on Sep. 11, 2002, now Pat. No. 6,706,383, and a continuation-in-part of application No. 10/241,985, filed on Sep. 12, 2002, now Pat. No. 6,684,704.

(51) Int. Cl.[7] ..... B32B 7/12

(52) U.S. Cl. ..... 428/354; 428/355 AC; 428/353; 428/447; 428/451; 428/483; 156/306.6; 156/329

(58) Field of Search ..... 428/354, 355 AC, 428/353, 447, 451, 483, 343; 156/306.6, 329

(56) References Cited

U.S. PATENT DOCUMENTS

| | | | |
|---|---|---|---|
| 1,338,647 | A | 4/1920 | Garner et al. |
| 4,446,254 | A | 5/1984 | Nakae et al. |
| 4,613,345 | A | 9/1986 | Thicke et al. |
| 4,852,646 | A | 8/1989 | Dittmer et al. |
| 4,946,903 | A | 8/1990 | Gardella, Jr. et al. |
| 5,461,101 | A | 10/1995 | Rothon et al. |
| 5,510,174 | A | 4/1996 | Litman |
| 5,624,303 | A | 4/1997 | Robinson |
| 5,733,176 | A | 3/1998 | Robinson et al. |
| 5,945,486 | A | 8/1999 | Vargo et al. |

(List continued on next page.)

FOREIGN PATENT DOCUMENTS

| | | |
|---|---|---|
| EP | 0 884 349 A1 | 12/1998 |
| JP | 01064776 | 10/1989 |
| JP | 08078369 | 3/1996 |
| JP | 9132661 | 5/1997 |
| JP | 11245164 | 9/1999 |
| JP | 2002036098 | 2/2002 |
| WO | WO 9605602 A1 | 2/1996 |
| WO | WO 99/10129 | 3/1999 |
| WO | WO 99/62673 | 12/1999 |

OTHER PUBLICATIONS

Hawley's Condensed Chemical Dicionary, Thirteenth Edition Copyright 1997 by John Wiley & Sons, Inc. Electrochemical Society (ECS) Elastometer, p. 437.

*Primary Examiner*—James J. Seidleck
*Assistant Examiner*—Melanie Bissett

(57) ABSTRACT

The present invention provides, chemical mechanical polishing pad with improved polishing properties and longevity for polishing semiconductor wafers. The polishing pad comprises a thermoplastic backing film and a pressure sensitive adhesive coupled to the thermoplastic backing film. The pressure sensitive adhesive is configured to couple a chemical mechanical polishing pad to a polishing platen. The pressure sensitive adhesive is further configured to provide an interface capable of substantially preventing delamination of the polishing pad from the polishing platen for at least about 4 days exposure to a polishing slurry medium having a pH of about 4 or higher.

17 Claims, 14 Drawing Sheets

U.S. PATENT DOCUMENTS 6,017,265 A 1/2000 Cook et al.
6,063,306 A 5/2000 Kaufman et al.
6,083,838 A 7/2000 Burton et al.
6,099,954 A 8/2000 Urbanavage et al.
6,106,754 A 8/2000 Cook et al.
6,126,532 A 10/2000 Sevilla et al.
6,132,298 A 10/2000 Zuniga et al.
6,150,271 A 11/2000 Easter et al.
6,267,644 B1 7/2001 Molnar
6,283,829 B1 9/2001 Molnar
6,291,349 B1 9/2001 Molnar
6,293,851 B1 9/2001 Molnar
6,346,202 B1 2/2002 Molnar
6,354,915 B1 3/2002 James et al.
6,413,153 B1 7/2002 Molar
6,419,556 B1 7/2002 Urbanavage et al.
6,428,388 B2 8/2002 Molnar
6,435,948 B1 8/2002 Molnar
6,585,574 B1 7/2003 Lombardo et al. ..... 451/285
6,706,383 B1 * 3/2004 Obeng et al. ..... 428/314.2
2002/0119286 A1 * 8/2002 Chen et al. ..... 428/131

* cited by examiner

POLISHING PAD RESISTANT TO DELAMINATION

CROSS-REFERENCE TO RELATED APPLICATIONS

This application is a continuation-in-part of U.S. application Ser. No. 10/241,074 now U.S. Pat. No. 6,706,383, entitled, "A POLISHING PAD SUPPORT THAT IMPROVES POLISHING PERFORMANCE AND LONGEVITY," to Yaw S. Obeng and Peter Thomas, filed on Sep. 11, 2002 and is a CIP of U.S. application Ser. No. 10/241,985 now U.S., Pat. No. 6,684,704, entitled, "MEASURING THE SURFACE PROPERTIES OF POLISHING PADS USING ULTRASONIC REFLECTANCE," to Yaw S. Obeng filed on Sep. 12, 2002 now which are commonly assigned with the present invention, and incorporated by reference as if reproduced herein in their entirety.

TECHNICAL FIELD OF THE INVENTION

The present invention is directed to polishing pads used for creating a smooth, ultra-flat surface on such items as glass, semiconductors, dielectric/metal composites, magnetic mass storage media and integrated circuits. More specifically, the invention is directed to adhesive materials that are suitable for adhering certain polishing pad supports to a polishing device, so as to extend the lifetime of the pad before delamination occurs.

BACKGROUND OF THE INVENTION

Chemical-mechanical polishing (CMP) is used extensively as a planarizing technique in the manufacture of VLSI integrated circuits. It has potential for planarizing a variety of materials in IC processing but is used most widely for planarizing metallizied layers and interlevel dielectrics on semiconductor wafers, and for planarizing substrates for shallow trench isolation.

In shallow trench isolation (STI), for example, large areas of field oxide must be polished to produce a planar starting wafer. Achieving acceptable planarization across the full diameter of a wafer using traditional etching processes has been largely unsuccessful. However, using conventional CMP, where the wafer is polished using a mechanical polishing wheel and a slurry of chemical etchant, unwanted oxide material is removed with a high degree of planarity.

Similarly, in multilevel metallization processes, each level in the multilevel structure contributes to irregular topography. Planarizing interlevel dielectric layers, as the process proceeds, is often now favored in many state-of-the-art IC fabrication processes. High levels of planarity in the metal layers is a common objective, and this is promoted by using plug interlevel connections. A preferred approach to plug formation is to blanket deposit a thick metal layer, comprising, for example W, Ti, TiN, on the interlevel dielectric and into interlevel windows, and then removing the excess metal using CMP. CMP may also be used for polishing an oxide layers, such as $SiO_2$, $Ta_2O_5$ or $W_2O_5$ or to polish nitride layers such as $Si_3N_4$, TaN, TiN.

There are, however, several deficiencies in conventional polishing pad materials. Various types of materials, such as polyurethane, polycarbonate, nylon, polyureas, felt, or polyester, have poor inherent polishing ability, and hence are not used as polishing pads in their virgin state. In certain instances, mechanical or chemical texturing may transform these materials, thereby rendering them useful in polishing. Another consideration important to preventing uneven polishing of wafers is the choice and longevity of the backing film used for attaching the polishing pad to the platen of the polishing table. The backing film cushions the wafer during polishing and compensates for thickness variations in the wafer or backing plate. Still another consideration is the adhesive used to attach the polishing pad to the platen.

The slurries used in chemical mechanical polishing are thought to cause delamination of the polishing pad from the platen of the polishing table. Ensuing problems can range from unsatisfactory planarization of wafers producing poor quality wafers in the early stages of delamination, to total destruction of wafers and polishing equipment, when the delaminated polishing pad flies off a moving polishing table. Delamination is thought to occur when the adhesive used to fix the polishing pad to the platen of the polishing table is chemically attacked by the slurry. This, in turn, results in adhesive failure at the adhesive/platen interface, probably due to dissolution of the adhesive. The reduction in the numbers of sufficiently high quality semiconductor wafers produced because of delamination contributes significantly to the overall cost of producing integrated circuits.

One approach to reduce losses in production due to delamination is to use an adhesive that strongly couples the polishing pad to the platen. This approach is based on the notion that if the polishing pad is tightly coupled to the platen, then the polishing slurry will less readily gain ingress between the platen and the pad to cause delamination. One problem with this approach, however, is that it becomes extremely difficult to change polishing pads. Special equipment is generally required to facilitate peeling such pads off of the platen. Often residual adhesive is left on the platen surface, necessitating the use of organic solvents to clean adhesive off of the platen. These additional removal and cleaning steps add to the total time and cost of producing integrated circuits.

Accordingly, what is needed is an improved CMP pad capable of providing a highly planar wafer surface and having improved longevity during CMP, while not experiencing the above-mentioned problems.

SUMMARY OF THE INVENTION

To address the above-discussed deficiencies, the present invention provides, in one embodiment, a chemical mechanical polishing pad for polishing semiconductor wafers. The polishing pad includes a thermoplastic backing film and a pressure sensitive adhesive coupled to the thermoplastic backing film. The pressure sensitive adhesive is configured to couple the polishing pad to a polishing platen and provide an interface capable of substantially preventing delamination of the chemical mechanical polishing pad from the polishing platen for at least about 4 days exposure to a polishing slurry medium having a pH of about 4 or higher.

In yet another embodiment, the present invention provides method of manufacturing a chemical mechanical polishing pad. The method comprises providing a thermoplastic foam polishing body and laminating a thermoplastic backing film to the thermoplastic foam polishing body. The method further comprises coupling a pressure sensitive adhesive to the thermoplastic backing film. The pressure sensitive adhesive is configured to couple a chemical mechanical polishing pad to a polishing platen and provide an interface, as described above. Still another embodiment of the present invention is a chemical mechanical polishing pad for polishing semiconductor wafers produced by the above-described method.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiments as a basis for designing or modifying other structures for carrying out the same purposes of the present invention. Those skilled in the art should also realize that such equivalent constructions do not depart from the scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

The present invention discloses a combination of polishing pad backings films and adhesive materials that provide superior polishing quality over a longer working life, as compared to conventional pad and adhesive combinations. In particular, certain combinations of adhesives and plastic backing films were found to provide surprisingly good resistance to acidic and oxidizing conditions found in slurry media, while retaining good shearing strength in the horizontal (platen) plane and low peel strength in the vertical plane (perpendicular to the platen).

In particular, it was discovered that a dual-sided pressure sensitive adhesive (PSA) comprising a platen side adhesive having a silicone based adhesive, and a backing film side adhesive having an acrylic based adhesive, provides surprisingly good resistance to delamination. It is thought that the silicon based adhesive's resistance to chemical attack by CMP slurries imparts resistance to delamination. Moreover, there is little ingress of slurry into the platen/adhesive interface and therefore only the periphery of the platen/adhesive interface comes in contact with the slurry.

The use of a silicon adhesive in a CMP application is contrary to the traditional view that silicone compounds from the adhesive will leach into a silicon wafer and irreversibly contaminant the wafer. In particular, it has long been thought that labile monomeric components of polysiloxanes would react with the silicon wafer surface and thereby deleteriously alter the semiconductive properties of the wafer. The present invention avoids these problems because: the silicon based adhesive is only on the platen side; the low amounts of ingress of the slurry into the platen/adhesive interface; and the silicon based adhesive's intrinsic resistance to chemical attack by CMP slurries.

For the purposes of the present invention, an adhesive is defined as any material capable of bonding polishing pad materials, in particular backing films, to polishing platens by chemical or mechanical action, or both, and which may be activated by water, non-aqueous solvents, pressure, heat, cold, or other means. The term pressure sensitive adhesive refers to a type of adhesive that adheres to a surface at room temperature by means of a briefly applied pressure only.

Figure 1:
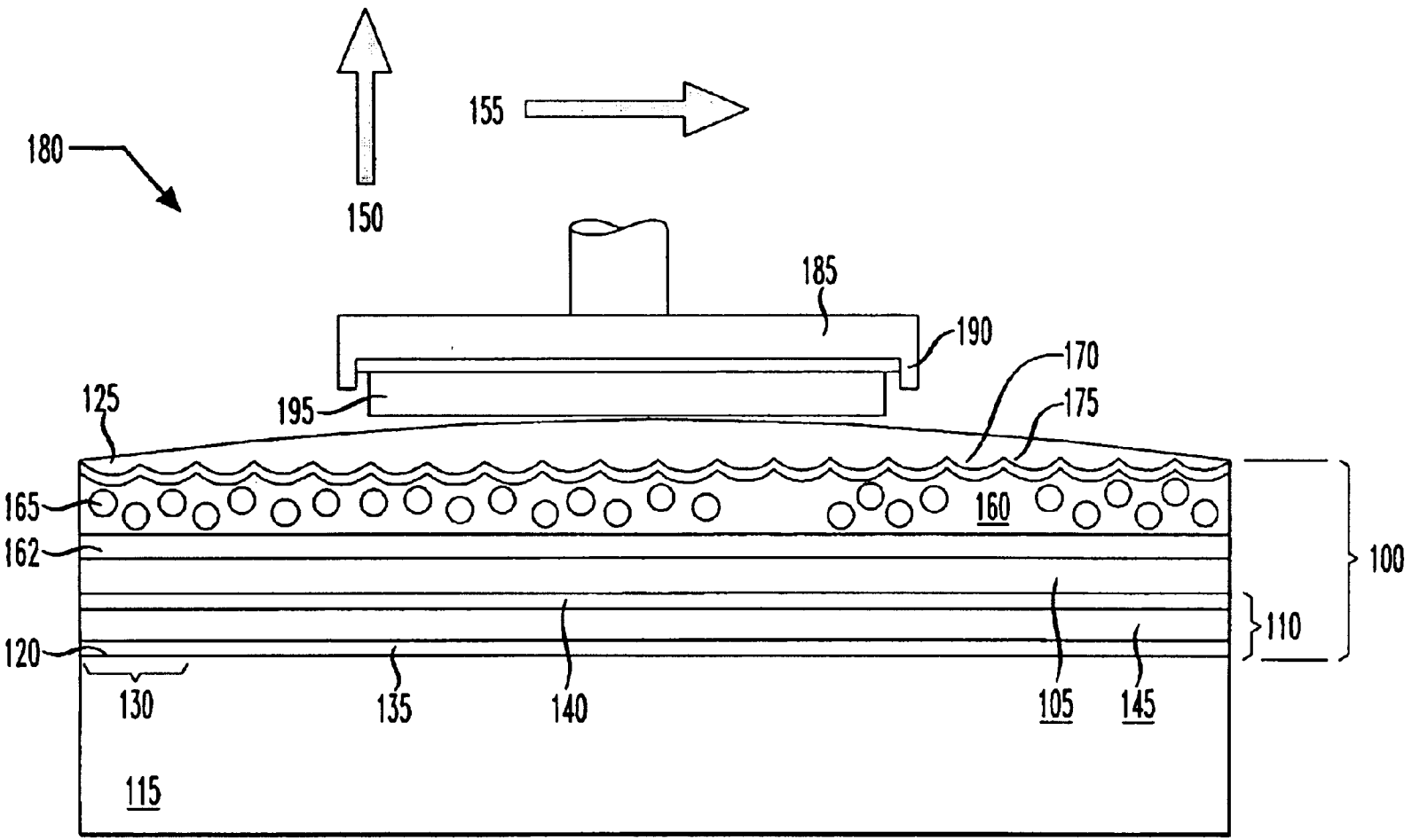
FIG. 1 illustrates a cross sectional polishing pad of the present invention.

FIG. 1 illustrates one embodiment of the present invention, a chemical mechanical polishing pad 100 for polishing semiconductor wafers. The polishing pad 100 includes a thermoplastic backing film 105 and a pressure sensitive adhesive 110 coupled to the thermoplastic backing film 105. The pressure sensitive adhesive 110 is configured to couple a chemical mechanical polishing pad 100 to a polishing platen 115.

The pressure sensitive adhesive 110 is also configured to provide an interface 120 capable of substantially preventing delamination of the chemical mechanical polishing pad 100 from the polishing platen 115 for at least about 4 days exposure to a polishing slurry medium 125 having a pH of about 4 or higher. More preferably, delamination is prevented for at least 14 days exposure to the polishing slurry medium 125. A substantial prevention of delamination is indicated by a slurry ingress 130 into the interface 120 of less than about 2 mm as further illustrated in the Experimental section to follow.

Preferred embodiments of the polishing pad 100 include the pressure sensitive adhesive 110 being dual sided, having a silicone based adhesive on a first side 135 couplable to said platen 115 and an acrylic based adhesive on a second side 140 couplable to said thermoplastic backing film 105. It is desirable to have a silicone based adhesive on the first side 135 only because the polishing platen 115 generally has a high surface energy. The thermoplastic backing film 105 is generally comprised of a low surface energy material, such as high density polyethylene that does not adhere to the silicone based adhesive with sufficient strength to couple the polishing pad 100 to the polishing platen 115.

It is advantageous for the pressure sensitive adhesive 110 to have a low monomeric silicone content because this minimizes the possibility of contaminating semiconductor wafers to be polishing. Though not limiting the scope of the present invention by theory, it is postulated that the likely source of any such contamination is from the silicone based adhesive on a first side 135 of the pressure sensitive adhesive 110. The monomeric silicone content of the silicone based adhesives is ideally low enough to be confined to the first side 135 during polishing.

The monomeric silicone content of the pressure sensitive adhesive 110 can be reduced to satisfactory levels through conventional manufacturing processes. The level of monomeric silicone in the finished tape construction can be determined by any number of conventional extraction procedures well known to those skilled in the art. For example, monomeric silicone can be ethanol-extracted from the pressure sensitive adhesive 110 or silicone based adhesive on a first side 135 and then re-dried under a nitrogen atmosphere. The residue of the extract can then be dried in nitrogen and analyzed for silicone content by measuring, for example, the absorption peak of silicone at 804 $cm^{-1}$ by Infrared Spectroscopy. In preferred embodiment, for example, a dried sample from an ethanol extract of the silicone based adhesive has a silicone content corresponding to less than about 100 absorption units at 804 $cm^{-1}$ per gram. More preferably the extract has less then about 50 and even more preferably less than about 20 absorption units at 804 $cm^{-1}$ per sample weight.

In other preferred embodiments of the polishing pad 100, the pressure sensitive adhesive 110 further includes a carrier film 145 comprising polyester, for example, and located between the first and second side 135, 140 of the pressure sensitive adhesive. The carrier film 145 may also comprise other polymeric material with sufficiently high surface energy for the silicone and acrylic based adhesive to adhere to the carrier film stronger than to the platen or thermoplastic backing film, respectively. Examples of such materials are nylon, high density polyethylene (HDPE) and unplasticised polyvinyl chloride (HDPE).

In still other preferred embodiments of the polishing pad 100 the thermoplastic backing film 105 is a high density polyethylene (i.e., density greater than about 0.96 gm/cc), and more preferably, a condensed high density polyethylene. Examples of a high density polyethylene suitable for use as a backing film 105 are product numbers DGDA-2490 and DGDA-2480 (Dow Chemical Corp), Product numbers Paxon BA7718 and Escorene HD7845 (Exxon Corp.). Other suitable materials for the backing film 105 include condensed low density polyethylene(LPDE), linear low density polyethylene (LLDPE), polypropylene (PP), ethyl vinyl acetate polyolefin co-polymers (EVA-PO), thermoplastic elastomers (TPE), thermoplastic rubber (TPR), polycarbonate (PC), polyamide 6,6, adipic-acid-1,6-hexanediamine polymer (PA6), and thermoplastic polyurethane (TPU). Preferably, the back film 105 is between about 5 and about 50 mil thick.

It is advantageous for the interface 120 to have high shear strength in a plane parallel to a plane of rotation of the platen 150. For example, the interface 120 has a shear strength in a plane parallel to a plane of polishing platen 150 equal to at least about 10000 hrs at 1000 g at room temperature (~72° F.), or about 10000 hrs at 500 grams at 158° F.

At the same time, to facilitate the replacement of polishing pads it is desirable for the interface 120 to have an intermediate peel strength in a plane perpendicular to the plane polishing 155. For example, the interface 120 has a peel strength of between about 1 and about 200 oz/inch, more preferably between about 10 and about 150 oz/inch, and even more preferably between about 10 and about 50 oz/inch, after 72 hours dwell at room temperature (~72° F.). Preferably, the peel strength remains substantially constant for at least up to about 24 hours in the polishing slurry medium 125, for example comprising up to 10% volume/volume $H_2O_2$ at pH 4.

Still other embodiments of the polishing pad further including a thermoplastic foam polishing body 160 coupled to the thermoplastic backing film 105. In certain embodiments, the thermoplastic foam polishing body 160 may comprise cross-linked polyolefins, such as polyethylene, polypropylene, and combinations thereof. In certain preferred embodiments, the polishing body 160 is comprised of a closed-cell foam of crosslinked homopolymer or copolymers. Examples of closed-cell foam crosslinked homopolymers comprising polyethylene (PE) include: Volara™ and Volextra™ from Voltek (Lawrence, Mass.); Aliplast™, from JMS Plastics Supply, Inc. (Neptune, N.J.); or Senflex T-Cell™ (Rogers Corp., Rogers, Conn.). Examples of closed-cell foams of crosslinked copolymers comprising polyethylene and ethylene vinyl acetate (EVA) include: Volara™ and Volextra™ (from Voltek Corp.); Senflex EVA™ (from Rogers Corp.); and J-foam™ (from JMS Plastics JMS Plastics Supply, Inc.).

In other preferred embodiments, the closed-cell foam of the thermoplastic foam polishing body 160 is comprised of a blend of crosslinked ethylene vinyl acetate copolymer and a low density polyethylene copolymer (i.e., preferably between about 0.1 and about 0.3 gm/cc). In yet other advantageous embodiments, the blend has a ethylene vinyl acetate:polyethylene weight ratio between about 1:9 and about 9:1. In certain preferred embodiments, the blend comprises EVA ranging from about 5 to about 45 wt %, preferably about 6 to about 25 wt % and more preferably about 12 to about 24 wt %. Such blends are thought to be conducive to the desirable production of concave cells having a small size as further discussed below. In still more preferred embodiments, the blend has a ethylene vinyl acetate:polyethylene weight ratio between about 0.6:9.4 and about 1.8:8.2. In even more preferred embodiments, the blend has a ethylene vinyl acetate:polyethylene weight ratio between about 0.6:9.4 and about 1.2:8.8.

In yet other advantageous embodiments, the thermoplastic foam polishing body 160 may be characterized as having at least about 85 wt % Xylene insoluble material. The process for measuring Xylene insoluble materials is well-known to those of ordinary skill in the art. Such processes may involve, for example, digestion of the blend in Xylene for 24 hours at 120° C. followed by drying and comparing the weight of the residual insoluble material to the predigestion material.

The thermoplastic foam polishing body 160 may further comprise up to about 25 wt % of an inorganic filler material. The inorganic filler may be comprised of any Group I, Group II or Transition Metal well known to those of ordinary skill in the art to impart desirable translucence, color or lubricant properties to the foam substrate. For example, the inorganic filler may be selected from the group consisting of Talc, Titanium Oxides, Calcium Silicates, Calcium Carbonate, Magnesium Silicates, and Zinc salts. The thermoplastic foam polishing body 160, in certain preferred embodiments, is comprised of about 17 wt % Talc. In other embodiments, the filler comprises silica (about 20 to about 25 wt %), zinc oxides (about 1 wt %), stearic acid (about 1 wt %), and other additives and pigments (up to about 2%) well known to those of ordinary skill in the art. Other conventional filler materials, such as that revealed in U.S. Pat. Nos. 6,419,556, 6,099,954, 6,425,816 and 6,425,803, incorporated by reference herein, are also within the scope of the present invention.

In still other preferred embodiments, the polishing body 160 comprises a thermoconductive polymer having a substrate with filler particles. The filler particles, containing a Group II salt, are incorporated within the substrate. For example, a Group II salt may be any cationic form of an element included in Group II of the Periodic Table, preferably, Magnesium (II), associated with any compatible anion, preferably, Oxide. Because such polishing bodies 160 have higher thermal conductivity as compared to conventional polishing pads, there is improved dissipation of heat generated from the friction and exothermic chemical events inherent in the polishing process. Moreover, the selective incorporation of certain types, amounts, shapes and sizes of the filler particles may be used to control thermal management during polishing.

In certain embodiments of the present invention, the Group II salt includes an anion comprising one of sulfate, stearate or carbonate. In certain preferred embodiments, the Group II salt includes an anion comprising oxide, such as Magnesium Oxide or Calcium Oxide. The other preferred embodiments, the Group II salt includes an anion comprising hydroxide, for example Magnesium Hydroxide. In embodiments where the anion is hydroxide, the endothermic decomposition of the hydroxide to oxide plus water, are thought to play a beneficial role in the thermal management and in improving wetability during the CMP process.

In certain preferred embodiments, the thermoconductive polymer has a thermal conductivity of greater than about 1 Watt m-1 K-1, preferably greater than about 5 Watts m-1 K-1, and most preferably greater than about 15 Watts m-1 K-1 to about 20 Watts m-1 K-1. In addition to having high thermal conductivity, to avoid deleterious effects on the function of transistors or other electrical components located on a semiconductor wafer to be polished, such as short circuits, the polishing 160 also preferably is electrically neutral or nonconducting. For example, the thermoconductive polymer should have an electrical volume resistivity of greater than about 1×1015 ohm cm−3 at 25° C., preferably greater than about 5×1015 ohm cm−3 at 25° C. Additionally, in certain preferred embodiments, the thermoconductive polymer is stable in the pH range of about 2 to about 12. The term stable as used herein means that the thermoconductive polymer, when incorporated into a polishing device, does not show visual signs of decomposing in the CMP slurry, nor fray or fragment during use. Additionally, the thermoconductive polymers are not subject to piezochromic effects. Thus, pressure loads associated with CMP do not substantially affect the polymer's thermoconductive properties. Such pressure loads, for example, may range from about 0.1 psi to about 50 psi, preferably about 0.5 to about 10 psi, more preferably about 1 psi to about 8 psi.

The above-mentioned substrate may be any polymer used in polishing pads for CMP applications, and compatible with the incorporation of filler particles throughout. For example, in certain preferred embodiments, the substrate may be composed of polyurethane, polyolefin or polyvinyl ester. Alternative embodiments of the substrate include polyurea, polycarbonate, aliphatic polyketone, polysulfone, aromatic polyketone, 6,6 nylon, 6,12 nylon or polyamide. In other embodiments, the substrate is a thermoplastic rubber or melt-processible rubber. However, embodiments where the substrate is composed of closed-cell polypropylene, polyethylene, crosslinked polyethylene, ethylene vinyl acetate, or polyvinylacetate are also within the scope of the present invention.

To a first approximation, for given filler particle composition, size and shape, the thermal conductivity increases in proportion to the amount of filler present. For example, in certain preferred embodiments, the filler particles comprise at least about 20%, and more preferably about 40 to about 70% by weight, of the thermoconductive polymer. The size and shape of the filler particles also affect the extent of thermal conductivity of the thermoconductive polymer. For example, in certain preferred embodiments, the filler particles have a spherical shape. In other preferred embodiments, the filler particles have an average diameter ranging from about 50 $\mu$m to about 1 $\mu$m, and more preferably from about 5 $\mu$m to about 1 $\mu$m. In certain advantageous embodiments, the filler particles are incorporated substantially throughout the substrate so as to provide a uniform distribution of particles in the substrate.

The thermoplastic foam polishing 160 is coupled to the thermoplastic backing film 105 via an adhesive 162, such as the pressure sensitive adhesive 110 used to couple the backing film 105 to the polishing platen 115. Alternatively, the thermoplastic foam polishing 160 is coupled by thermally welding, or by extrusion coating a molten backing film 105 on a sheet of thermoplastic foam 160. Coupling may also be achieved using chemical bonding processes. In certain advantageous embodiments, the thermoplastic foam polishing 160 has a surface comprised of concave cells 170 and a polishing agent 175 coating an interior surface 180 of the concave cells 170.

In certain embodiments, the thermoplastic foam polishing body 160 has cells 165 formed throughout the body. In certain preferred embodiments, the cells 165 are substantially spheroidal. In other preferred embodiments, the size of the cells 165 are such that, on skiving the substrate, the open concave cells 170 at the surface of the substrate have an average size between about 100 microns and 600 microns. The average size of the concave cells 165 ranges from about 100 to about 350 microns, preferably about 100 to about 250 microns and more preferably about 115 to about 200 microns. Cell size 165 may be determined using standard protocols, developed and published by the American Society for Testing and Materials (West Conshohocken, Pa.), for example, such as ASTM D3576, incorporated herein by reference.

In certain preferred embodiments, where the shape of the cell 165 is substantially spherical, cell size is approximately equal to the mean cell diameter. In embodiments comprising EVA copolymer, for example, cell diameter is a function of the EVA content of co-polymer bend, as disclosed by Perez et al. J. Appl. Polymer Sci, vol. 68, 1998 pp 1237–1244, incorporated by reference herein. As disclosed by Perez et al. bulk density and cell density are inversely related. Thus, in other preferred embodiments, the density of concave cells 170 at the surface of the substrate ranges between 2.5 and about 100 cells/mm$^2$, and more preferably, between about 60 and 100 cells/mm$^2$. Cell density may be determined, for example, from visual inspection of microscopic images of the substrate's surface.

The polishing agent 175 may comprise one or more ceramic compounds or one or more organic polymers, resulting from the grafting of the secondary reactants on the polishing body's surface, as disclosed in U.S. Pat. No. 6,579,604 entitled, "A METHOD OF ALTERING AND PRESERVING THE SURFACE PROPERTIES OF A POLISHING PAD AND SPECIFIC APPLICATIONS THEREFOR," to Yaw S. Obeng and Edward M. Yokley, incorporated herein by reference. The ceramic polishing agent 175 may comprise an inorganic metal oxide resulting when an oxygen-containing organometallic compound is used as the secondary reactant to produce a grafted surface. For example, in certain embodiments, the polishing agent 175 is an amorphous silica or titanium oxide. In such embodiments, the secondary plasma mixture includes titanium. Other examples include the secondary plasma mixture including transition metal such as, manganese or tantalum. However, any metal element capable of forming a volatile organometallic compound, such as metal ester contain one or more oxygen atoms, and capable of being grafted to the polymer surface is suitable.

Silicon may also be employed as the metal portion of the organometallic secondary plasma mixture. In these embodiments, the organic portion of the organometallic reagent may be an ester, acetate, or alkoxy fragment. In preferred embodiments, the polishing agent 175 is selected from a group of ceramics consisting of Silicon Oxides and Titanium Oxides, such as Silicon Dioxide and Titanium Dioxide; Tetraethoxy Silane Polymer; and Titanium Alkoxide Polymer.

Numerous other secondary reactants may be used to produce the ceramic polishing agent 175, however. The secondary plasma reactant may include ozone, alkoxy silanes, water, ammonia, alcohols, mineral sprits or hydrogen peroxide. For example, in preferred embodiments, the secondary plasma reactant may be composed of titanium esters, tantalum alkoxides, including tantalum alkoxides wherein the alkoxide portion has 1–5 carbon atoms; manganese acetate solution in water; manganese alkoxide dissolved in mineral spirits; manganese acetate; manganese acetylacetonate; aluminum alkoxides; alkoxy aluminates; aluminum oxides; zirconium alkoxides, wherein the alkoxide has 1–5 carbon atoms; alkoxy zirconates; magnesium acetate; and magnesium acetylacetonate. Other embodiments are also contemplated for the secondary plasma reactant, for example, alkoxy silanes and ozone, alkoxy silanes and ammonia, titanium esters and water, titanium esters and alcohols, or titanium esters and ozone.

Alternatively, the polishing agent 175 may comprise an organic polymers when organic compounds are used as the secondary plasma reactant. Examples of such secondary reactants include: allyl alcohols; allyl amines; allyl alkylamines, where the alkyl groups contain 1–8 carbon atoms; allyl ethers; secondary amines, where the alkyl groups contain 1–8 carbon; alkyl hydrazines, where the alkyl groups contain 1–8 carbon atoms; acrylic acid; methacrylic acid; acrylic acid esters containing 1–8 carbon atoms; methacrylic esters containing 1–8 carbon atoms; or vinyl pyridine, and vinyl esters, for example, vinyl acetate. In certain preferred embodiments, the polishing agent 175 is selected from a group of polymers consisting of Polyalcohols and Polyamines.

The polishing pad 100 is depicted in FIG. 1 in a preferred environment, a polishing apparatus 180. The apparatus 180, comprises a mechanically driven carrier head 185 and carrier ring 190 to secure a semiconductor wafer 195. The carrier head 185 is positionable against the polishing platen 115 to impart a polishing force against the polishing platen 115.

Figure 2A:
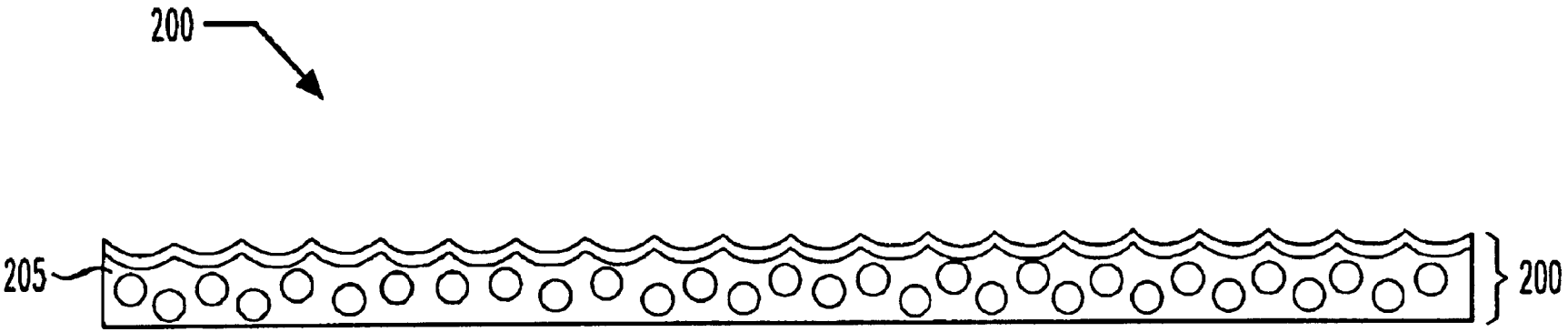
FIGS. 2A–C illustrate sectional views of selected steps in a method for making a polishing pad according to the principles of the present invention.
Figure 2B:
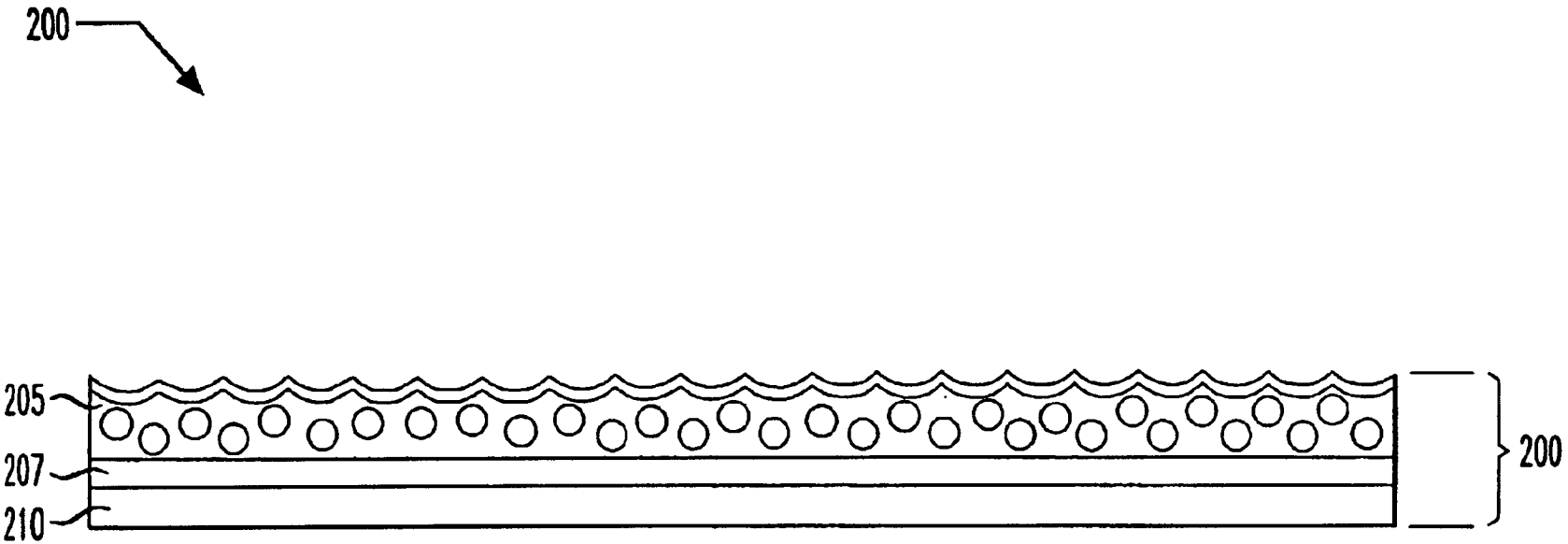
Figure 2C:
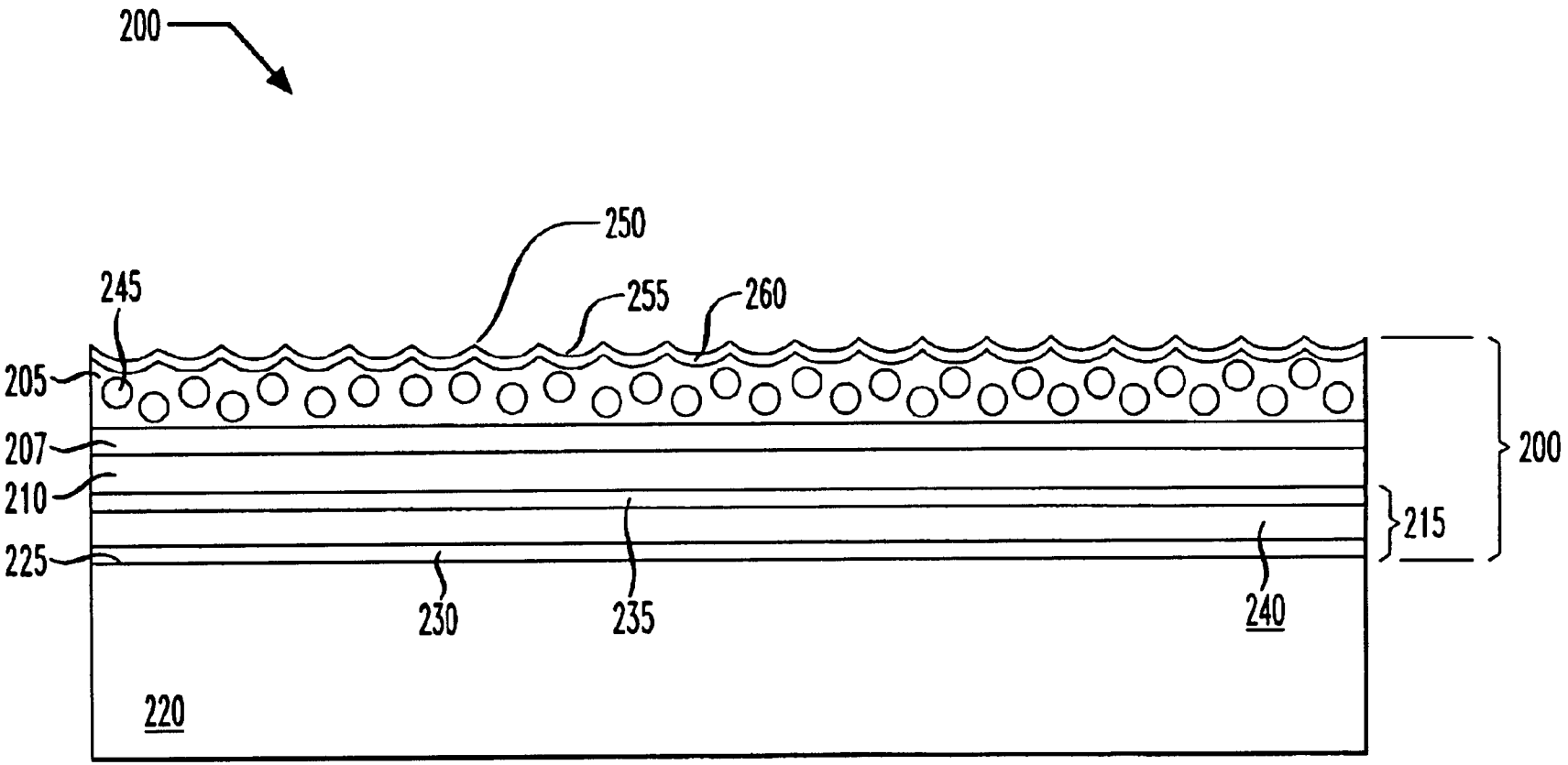
Figure 3A:
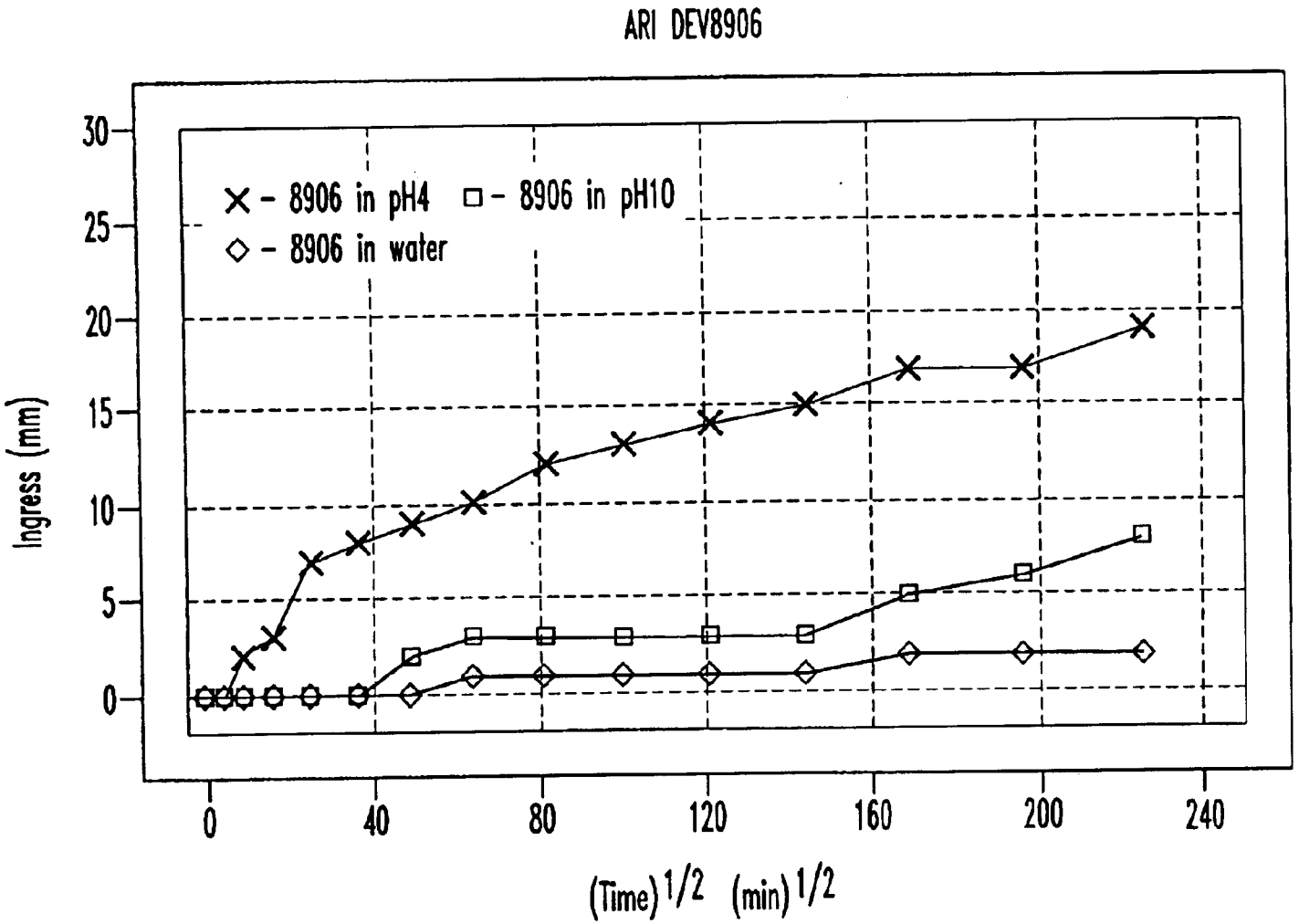
FIGS. 3A TO 3I present exemplary data of ingress tests for pressure sensitive adhesives of the present invention, as well as other adhesives.
Figure 3B:
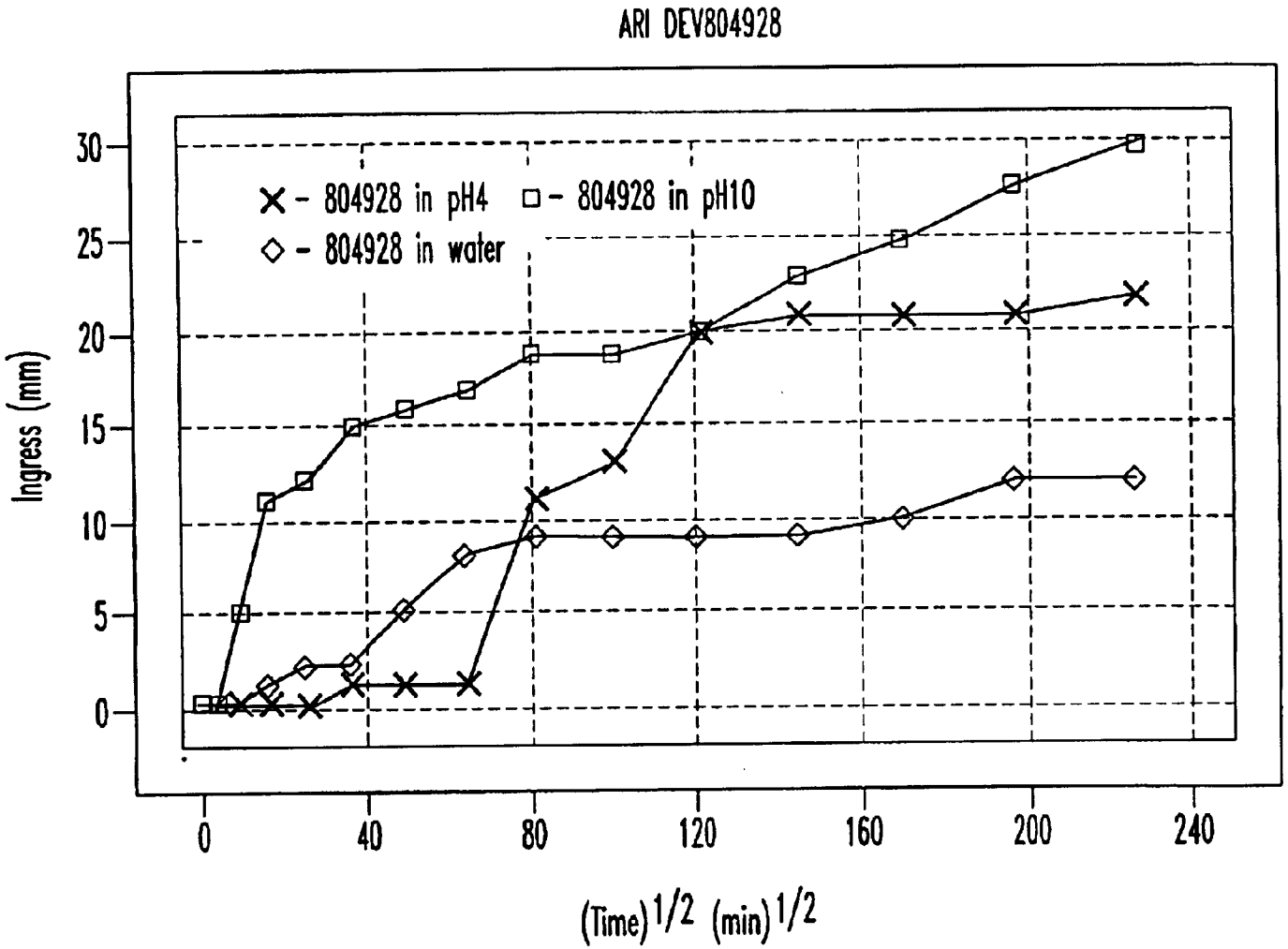
Figure 3C:
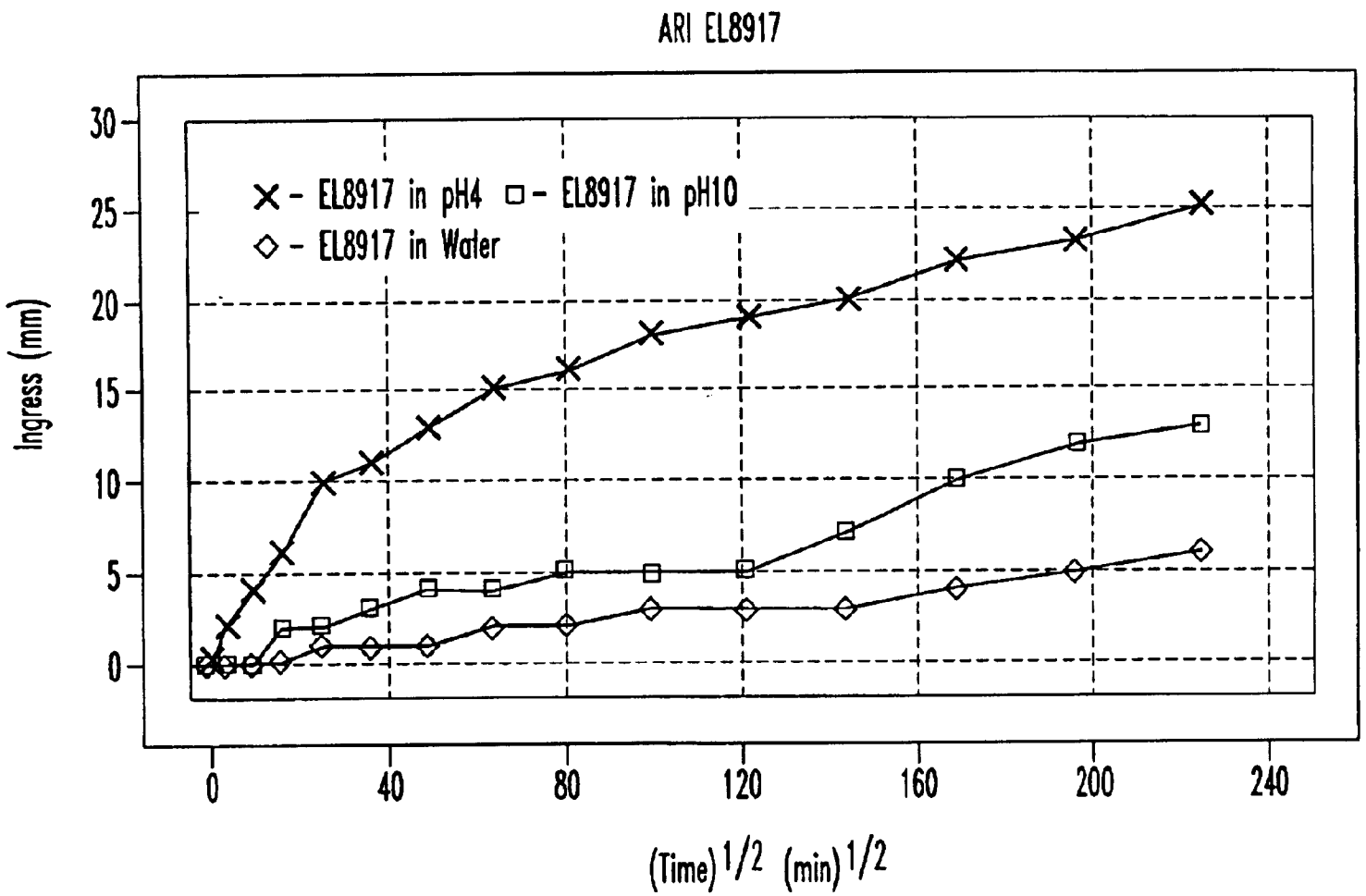
Figure 3D:
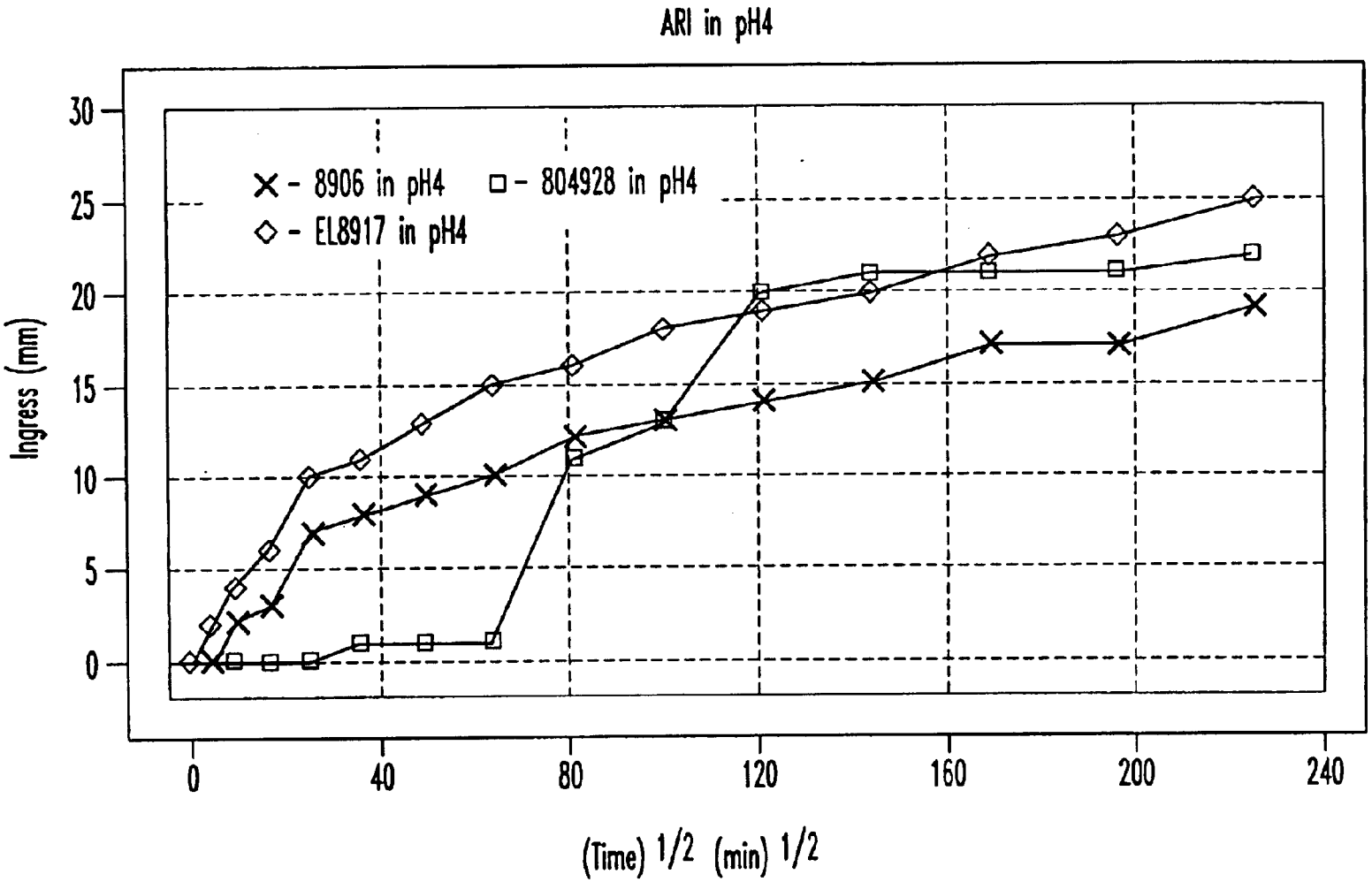
Figure 3E:
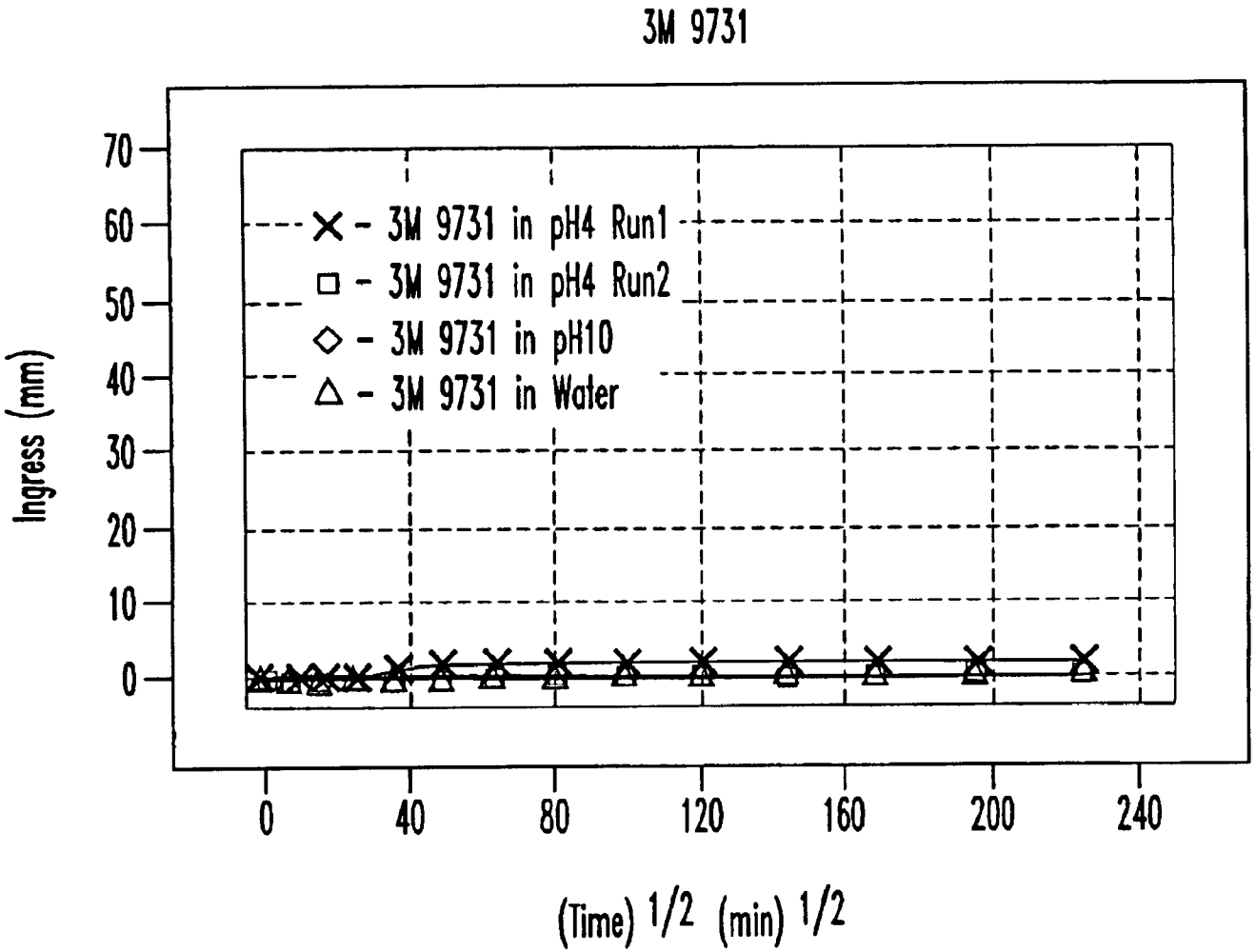
Figure 3F:
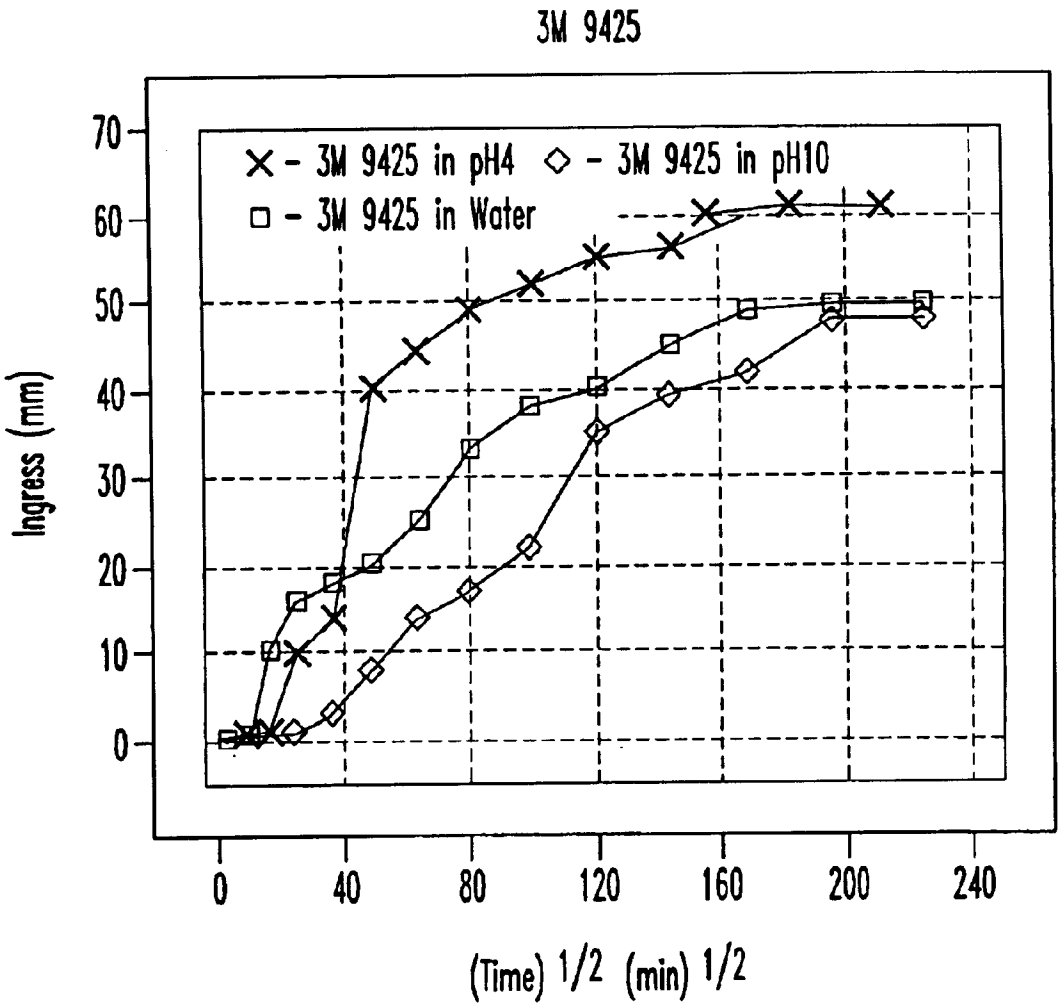
Figure 3G:
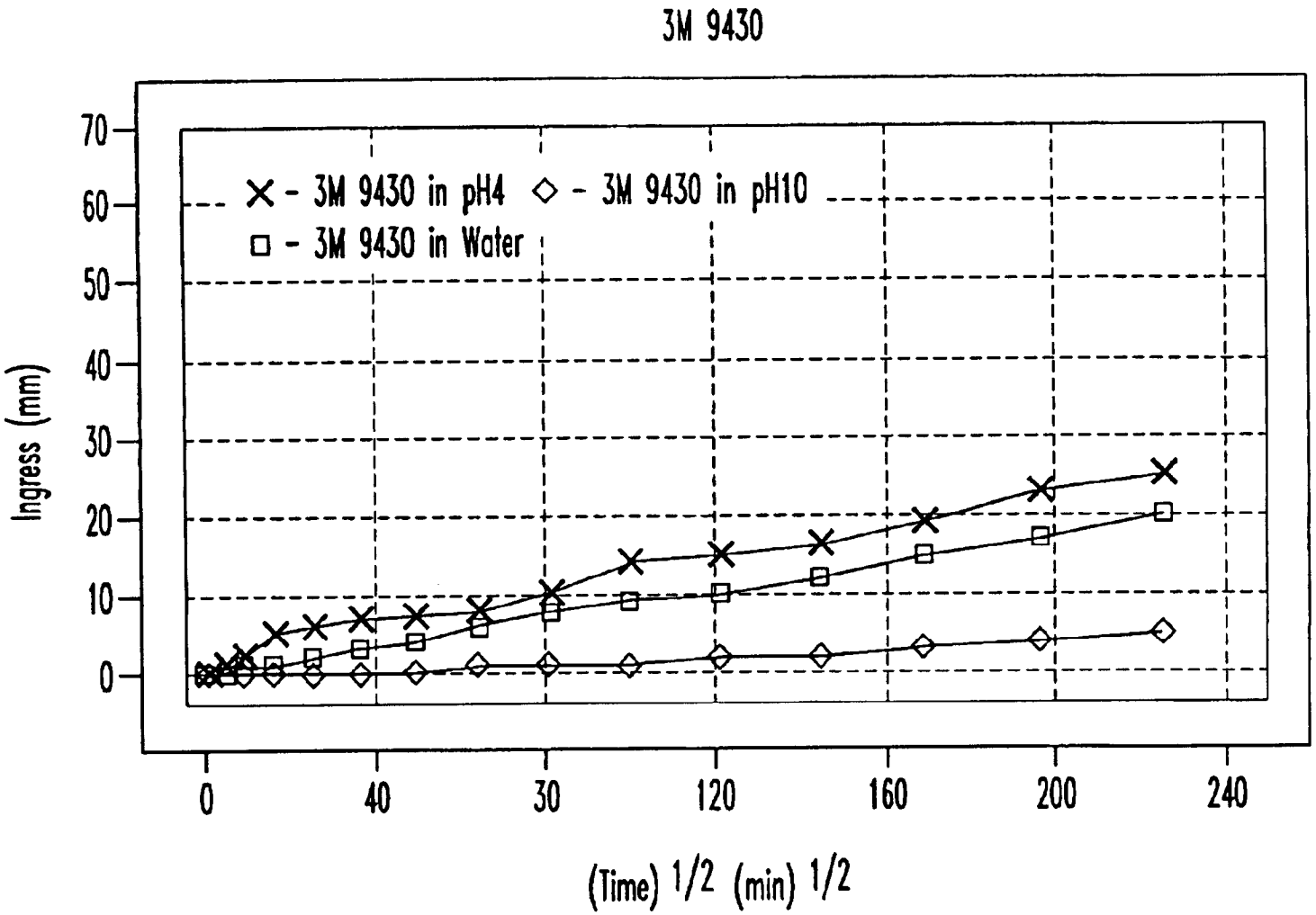
Figure 3H:
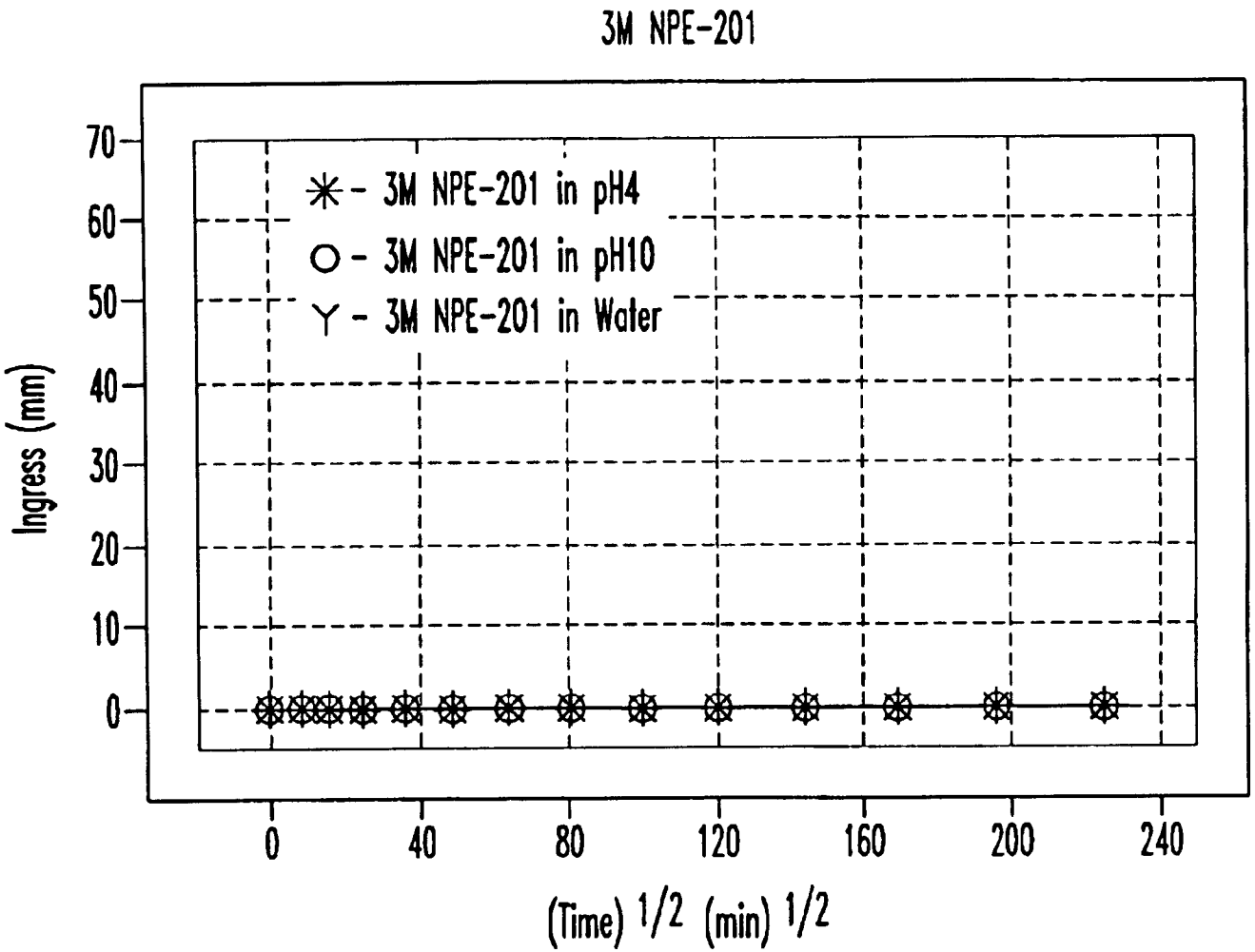
Figure 3I:
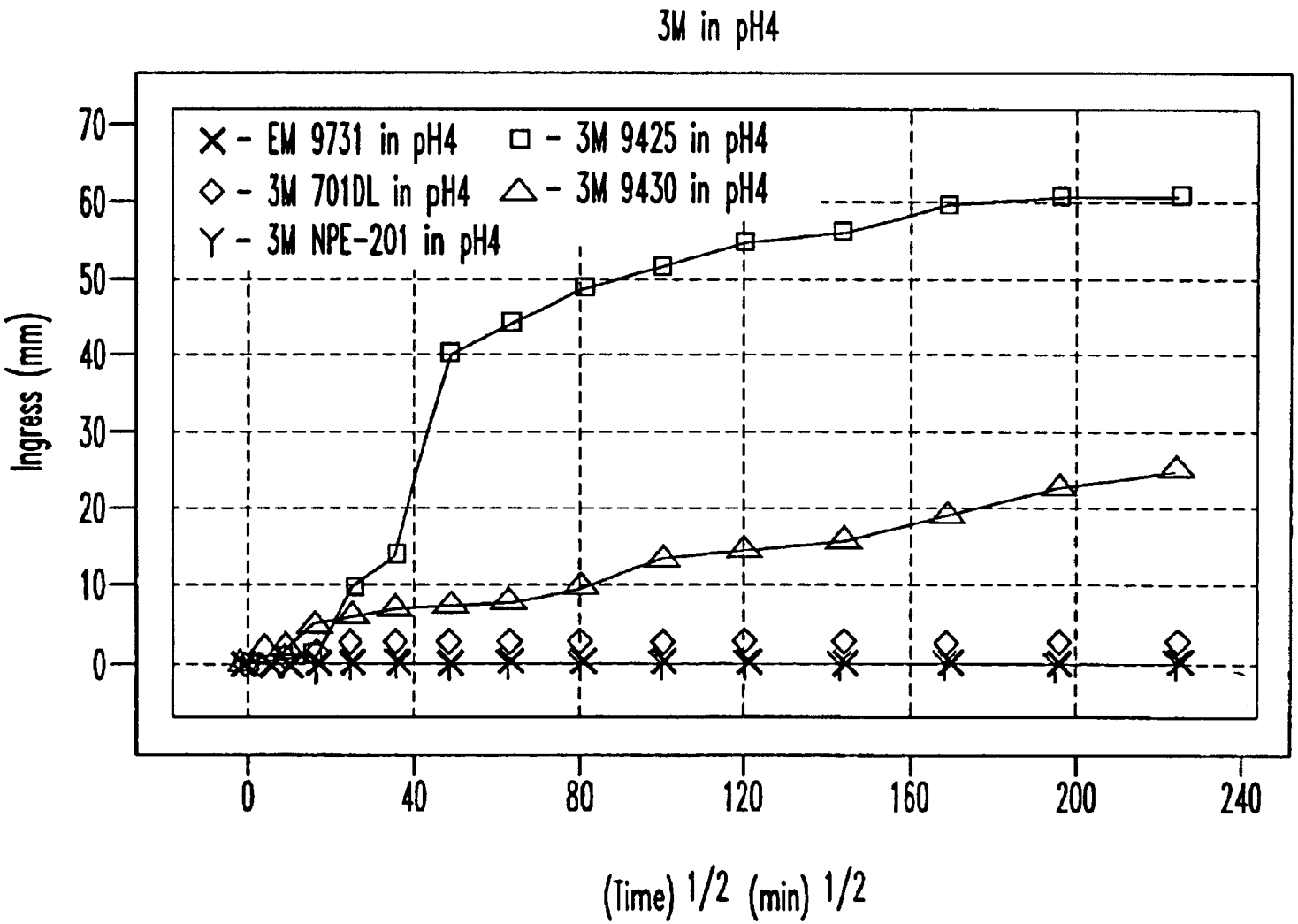

FIGS. 2A–2C illustrate sectional views of selected steps in yet another embodiment of the present invention, a method of manufacturing a chemical mechanical polishing pad 200. As shown in FIG. 2A the method comprises providing a thermoplastic foam polishing 205. As shown in FIG. 2B, the method also includes laminating a thermoplastic backing film 210 to the thermoplastic foam polishing 205. Laminating is achieved via chemical bonding using conventional adhesives 207, such as epoxy or other materials well known to those skilled in the art, or pressure sensitive adhesives 207 such as a dual sided material, both sides being acrylic based adhesive. In other preferred embodiments laminating is achieved via extrusion coating of the molten backing film material onto the foam, while in still other embodiments the backing film 210 is thermally welded to the thermoplastic foam polishing 205.

The method further includes coupling a pressure sensitive adhesive 215 to the thermoplastic backing film 210 (FIG. 2C). As noted above, the pressure sensitive adhesive 215 is configured to couple a chemical mechanical polishing pad 200 to a polishing platen 220 and provide an interface 225 capable of substantially preventing delamination of the polishing pad 200 from the polishing platen 220 for at least about 4 days exposure to a polishing slurry medium having a pH of about 4 or higher.

Preferably the pressure sensitive adhesive 215 comprises a dual sided tape having a first side 230 comprising a silicone based adhesive and a second side 235 comprising an acrylic based adhesive sandwiched between a carrier film 240. The acrylic based adhesive is coupled to the thermoplastic backing film 210 and the silicone based adhesive is configured to be coupled to the polishing platen 220.

Yet another embodiment of the present invention, a chemical mechanical polishing pad for polishing semiconductor wafers produced by the above-described process, is illustrated in FIG. 2C. Any of the above-described embodiments of the polishing body 205, backing film 210 and pressure sensitive adhesive 215 may be used in the method of manufacturing a chemical mechanical polishing pad 200.

For instance, providing the thermoplastic foam polishing body 205 includes exposing cells 245 within the foam polishing body 205 to form a surface 250 comprising concave cells 255 and coating an interior surface of the concave cells with a polishing agent 260. The size of the closed cells 245 within the foam polishing body 205 affects the size of the concave cells 255 ultimately formed on the surface 250. Several factors affect the size of the closed cells 245. The relative amounts of ethylene vinyl acetate copolymer and polyethylene may be controlled in order to advantageously adjust the size of cells produced during the foaming process. In addition, the kind of foaming process used may result in different cells sizes. The concave cells 255 preferably have an average size of between about 100 microns and about 600 microns and a cell density of at least about 4.5 cells/mm$^2$, and more preferably a size between about 100 microns and about 200 microns and a cell density of at least about 60 cells/mm$^2$.

Any conventional foaming process well know to those of ordinary skill in the art may be used to provide the foam polishing body 205. The foaming process may include, for example, blending polymers comprising the foam polishing body 205 in a blender. The foaming process may also include crosslinking (XL) polymers in the foam polishing body 205, using irradiation or chemical means to achieve crosslinking. The foaming process may further include forming a mixture of the foam body 205 and a blowing agent, preferably under pressure, and extruding the mixture through a conventional die to form sheets of closed-cell foams.

Exposing cells 245 to form a surface comprising concave cells 255 may be achieved by any conventional process well known to those of ordinary skill in the art. For example, exposing may be achieved by fixing the foam polishing body 205 on a planar surface, and cutting a thin layer (i.e., between about 1200 microns and about 2000 microns) from the surface of the foam polishing body 205. In certain preferred embodiments, skiving or cutting may be performed using a skiving device, such as a those provided by Fecken-Kirfel, (Aachen, Germany).

Coating the interior surface with a polishing agent 260 is achieved using the grafting procedure disclosed in U.S. Pat. No. 6,579,604 incorporated herein by reference. Thus, in certain embodiments, coating comprises exposing the concave cells interior surface 255 to an initial plasma reactant (1st plasma reactant) to produce a modified surface thereon. Coating may further comprise exposing the modified surface to a secondary plasma reactant (2nd plasma reactant) to create a grafted surface on the modified surface, the grafted surface comprising the polishing agent 260. Any of the primary and secondary reactants or procedures described in U.S. Pat. No. 6,579,604 may be used in the grafting process to coat the polishing agent 260 on the interior surface of the concave cells 245 of the foam polishing body 205.

Having described the present invention, it is believed that the same will become even more apparent by reference to the following experiments. It will be appreciated that the experiments are presented solely for the purpose of illustration and should not be construed as limiting the invention. For example, although the experiments described below may be carried out in a laboratory setting, one skilled in the art could adjust specific numbers, dimensions and quantities up to appropriate values for a full-scale plant setting.

EXPERIMENTS

Several commercially available PSAs were examined to characterize slurry ingress kinetics and peel strength in different types of media. Product number 9731 from 3M Company Inc. (St. Paul, Minn.), is dual sided PSA, having a silicone adhesive on one side, and an acrylic adhesive on the other side, of a polyester carrier film. Several other 3M products were tested: 9425 a mixture of acrylate polymers and poly vinyl chloride, 701DL, 9430, 9495LSE and NPE-201. In addition, Product Numbers DEV8906, DEV804928, and EL8917 from Adhesive Research Inc. (Glenrock, Pa.) were tested. Product Number FT 8300, an acrylic adhesive on a polyester carrier film, from Avery Dennison Inc. (Painesville, Ohio) was also tested.

Experiment 1

The ingress of solutions having different pHs was investigated for various combinations of PSAs and backing films. The PSAs and backing films were coupled to each other and the pad adhered to the polishing platen of a commercial bench-top polisher. The assembly was flooded with a continuous flow of commercial buffers (Fisher Scientific, Pittsburgh, Pa.) at pHs ranging from 4 to 10 to simulate slurry flow during chemical mechanical polishing. The ingress of the solutions into the interface between the PSA and backing film was determined by measuring the distance traveled by the leading edge of the fluid intrusion. To facilitate the measurements, transparent thermoplastic sheets, comprised of polycarbonate or high density polyethylene, were used to simulate the backing film of a polishing pad.

Exemplary results showing ingress, in units of mm, as a function of the square root of the soaking time are presented in FIGS. 3A–3I. The ingress data are plotted as a function of square root of time to see if ingress is diffusion limited. A straight line indicates a diffusion limited mechanism. Product number 9731 had substantially slower ingress rates than other PSAs. In a pH 4 solution, for example, ingress was less than about 2 mm after $(80\ \text{min})^{1/2}$ (about 4.4 days), with even slower rates of ingress at neutral and alkaline pHs (about 14 days).

Experiment 2

The effect of oxidizing solutions on the peel strength of various adhesive backing film combinations was investigated. Experiments were conducted on various PSAs sandwiched between stainless steel plates and aluminum strips after being soaked for times ranging from 0 to about 24 hours in a solution adjusted to about pH 4 in the presence and absence of 1–10% $H_2O_2$. Peel strength was measured using a model AR-1000 Adhesion/Release Tester (Cheminstruments, Mentor, Ohio) using a test angle of 90°. Data analysis was performed using EZ STATS Analysis software, provided by the manufacturer.

Figure 4:
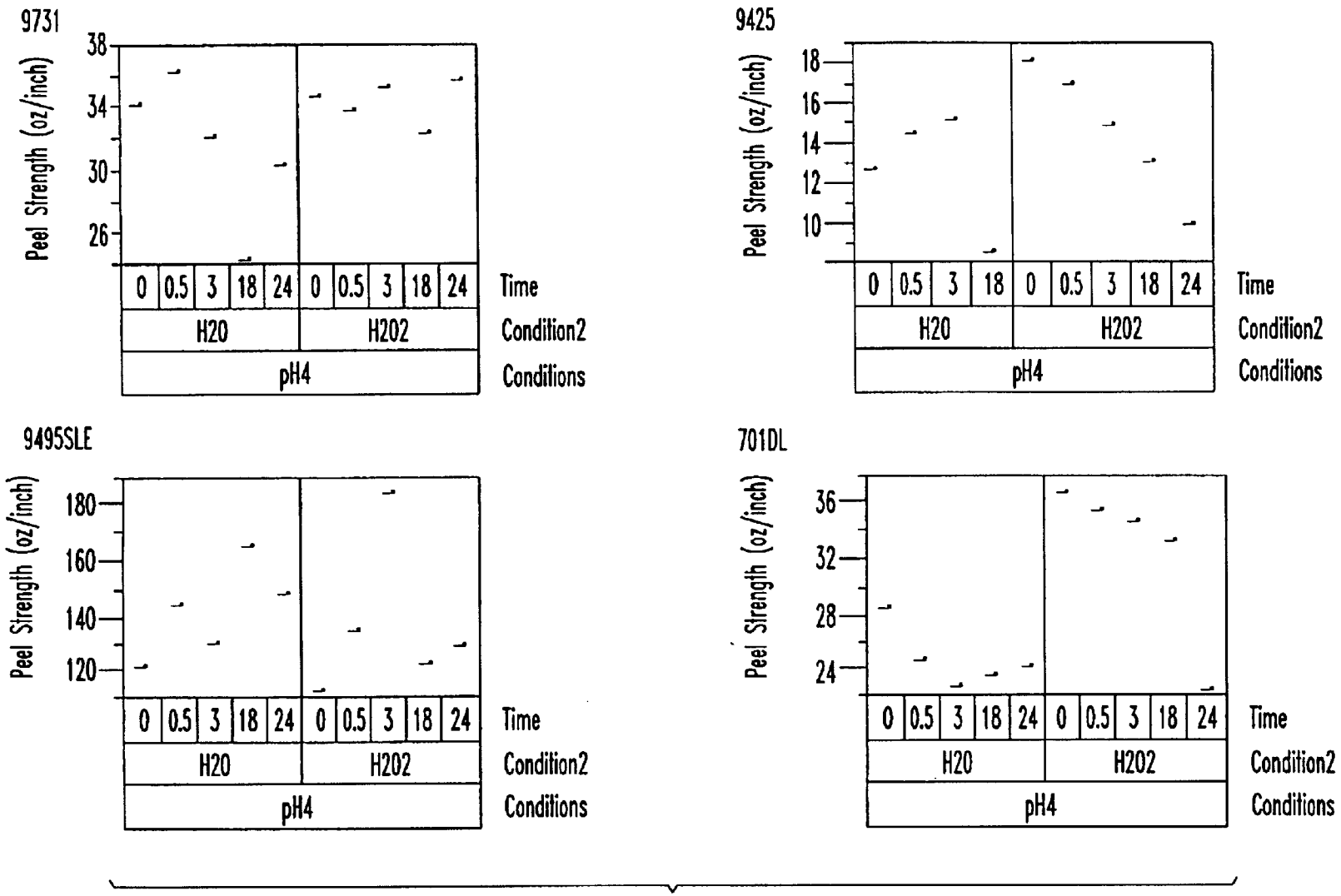
FIG. 4 presents exemplary data of peel strength tests for pressure sensitive adhesives of the present invention, as well as other adhesives.

Exemplary results are presented in FIG. 4, in units of oz/inch. The results from these studies show that the peel strength of product number 9731 was more resistant to change caused by free radicals and oxidative species generated by the $H_2O_2$, as compared to other adhesives. Unlike other adhesives, the peel strength of product number 9731 desirably remained constant for dwell times up to at least 24 hours and at intermediate values that would be conducive to a good ease of use.

Although the present invention has been described in detail, those skilled in the art should understand that they can make various changes, substitutions and alterations herein without departing from the scope of the invention.

What is claimed is:

1. A chemical mechanical polishing pad for polishing semiconductor wafers, comprising:

a thermoplastic backing film; and a pressure sensitive adhesive coupled to said thermoplastic backing film, wherein said pressure sensitive adhesive is dual sided having a silicone based adhesive on a first side couplable to a polishing platen and an acrylic based adhesive on a second side couplable to said thermoplastic backing film, said pressure sensitive adhesive configured to couple a chemical mechanical polishing pad to said polishing platen and provide an interface capable of substantially preventing delamination of said chemical mechanical polishing pad from said polishing platen for at least about 4 days exposure to a polishing slurry medium having a pH of about 4 or higher.

2. The polishing pad as recited in claim 1 wherein an extract of said silicone based adhesive has a monomeric silicon content of corresponding to less than about 100 absorption units at 804 $cm^{-1}$ per gram of said silicone based adhesive extracted.

3. The polishing pad as recited in claim 1 wherein said pressure sensitive adhesive further includes a carrier film including polyester and located between said silicone based adhesive and said acrylic based adhesive.

4. The chemical mechanical polishing pad as recited in claim 1, wherein said thermoplastic backing film is a high density polyethylene.

5. The chemical mechanical polishing pad as recited in claim 1, wherein said interface has a shear strength, in a plane parallel to a plane of rotation of said polishing platen, of at least about 10000 hours at 1000 grams at 72° F.

6. The chemical mechanical polishing pad as recited in claim 1, wherein said interface has a peel strength in a plane perpendicular to said polishing platen of between about 1 and about 200 oz/inch after 48 hour dwell at 72° F.

7. The chemical mechanical polishing pad as recited in claim 6, wherein said peel strength remains substantially constant for at least up to about 24 hours in said polishing slurry medium.

8. The chemical mechanical polishing pad as recited in claim 1, further including a thermoplastic foam polishing body coupled to said thermoplastic backing film, wherein said thermoplastic foam polishing body is a closed-cell foam comprised of a blend of cross-linked ethylene vinyl acetate copolymer and a low or medium density polyethylene copolymer having a ethylene vinyl acetate:polyethylene ratio between about 1:9 and about 9:1.

9. The chemical mechanical polishing pad as recited in claim 1, further including a thermoplastic foam polishing body coupled to said thermoplastic backing film, wherein said thermoplastic foam polishing body is a closed-cell foam comprised of a blend of cross-linked ethylene vinyl acetate copolymer and a low or medium density polyethylene copolymer having an ethylene vinyl acetate:polyethylene ratio between about 0.6:9.4 and about 1.8:8.2.

10. The chemical mechanical polishing pad as recited in claim 8, wherein said thermoplastic foam polishing body has a surface comprised of concave cells and a polishing agent coating an interior surface of said concave cells.

11. The chemical mechanical polishing pad as recited in claim 10, wherein said polishing agent is an amorphous silica or titanium oxide.

12. A chemical mechanical polishing pad for polishing semiconductor wafers produced by a process comprising:

providing a thermoplastic foam polishing body;

laminating a thermoplastic backing film to said thermoplastic foam polishing body; and coupling a pressure sensitive adhesive to said thermoplastic backing film, wherein said pressure sensitive adhesive comprises a dual sided tape having a silicone based adhesive and an acrylic based adhesive sandwiched between a carrier film, said acrylic based adhesive coupled to said thermoplastic backing film and said silicone based adhesive configured to be coupled to a platen of a polishing table said pressure sensitive adhesive configured to couple a chemical mechanical polishing pad to a polishing platen and provide an interface capable of substantially preventing delamination of said chemical mechanical polishing pad from said polishing platen for at least about 4 days exposure to a polishing slurry medium having a pH of about 4 or higher.

13. The chemical mechanical polishing pad of claim 12, wherein said interface has a shear strength, in a plane parallel to a plane of rotation of said polishing platen, of at least about 10000 hours at 1000 grams at 72 degree F.

14. The chemical mechanical polishing pad of claim 12, wherein said interface has a peel strength in a plane perpendicular to said polishing platen of between about 1 and about 200 oz/inch after 48 hour dwell at 72° F.

15. A method of manufacturing a chemical mechanical polishing pad comprising:

providing a thermoplastic foam polishing body;

laminating a thermoplastic backing film to said thermoplastic foam polishing body; and coupling a pressure sensitive adhesive to said thermoplastic backing film, wherein said pressure sensitive adhesive is dual sided having a silicone based adhesive on a first side couplable to a polishing platen and an acrylic based adhesive on a second side couplable to said thermoplastic backing film said pressure sensitive adhesive configured to couple a chemical mechanical polishing pad to said polishing platen and provide an interface capable of substantially preventing delamination of said chemical mechanical polishing pad from said polishing platen for at least about 4 days exposure to a polishing slurry medium having a pH of about 4 or higher.

16. The method as recited in claim 15, wherein said pressure sensitive adhesive further includes a carrier film including polyester and located between said silicone based adhesive and said acrylic based adhesive.

17. The method as recited in claim 15, wherein said thermoplastic backing film is a high density polyethylene.

* * * * *

UNITED STATES PATENT AND TRADEMARK OFFICE

CERTIFICATE OF CORRECTION

PATENT NO. : 6,838,169 B2
DATED : January 4, 2005
INVENTOR(S) : Yaw S. Obeng

It is certified that error appears in the above-identified patent and that said Letters Patent is hereby corrected as shown below:

Column 7,
Lines 1-25, should appear as follows
-- In certain preferred embodiments, the themoconductive polymer has a thermal conductivity of greater than about 1 Watt m-1 K-1, preferably greater than about 5 Watts m-1 K-l, and most preferably greater than about 15 Watts m-1 K-1 to about 20 Watts m-1 K-1. In addition to having high thermal conductivity, to avoid deleterious effects on the function of transistors or other electrical components located on a semiconductor wafer to be polished, such as short circuits, the polishing body 160 also preferably is electrically neutral of nonconducting. For example, the thermoconductive polymer should have an electrical volume resistivity of greater than about 1.times.1015 ohm cm-3 at 25.degree. C., preferably greater than about 5.times.1015 ohm cm-3 at 25.degree. C. Additionally, in certain preferred embodiments, the thermoconductive polymer is stable in the pH range of about 2 to about 12. The term stable as used herein means that the thermoconductive polymer, when incorporated into a polishing device, does not show visual signs of decomposing in the CMP slurry, nor fray of fragment during use. Additionally, the thermoconductive polymers are not subject to piezochromic effects. Thus, pressure loads associated with CMP do not substantially affect the polymer's thermoconductive properties. Such pressure loads, for example, may range from about 0.1 psi to about 50 psi, preferably about 0.5 to about 10 psi, more preferably about 1 psi to about 8 psi. --

Column 7,
Lines 56-67, should appear as follows:
-- The thermoplastic foam polishing body 160 is coupled to the thermosplastic backing film 105 via an adhesive 162, such as the pressure sensitive adhestive 110 used to couple the backing film 105 to the polishing platen 115. Alternatively, the thermoplastic foam polishing body 160 is coupled by thermally welding, or by extrusion coating a molten backing film 105 on a sheet of thermoplastic foam polishing body 160. Coupling may also be achieved using chemical bonding process. In certain advantageous embodiments, the thermoplastic foam polishing body 160 has a surface comprised of concave cells 170 and a polishing agent 175 coating an interior surface 180 of the concave cells 170. --

UNITED STATES PATENT AND TRADEMARK OFFICE

CERTIFICATE OF CORRECTION

PATENT NO. : 6,838,169 B2
DATED : January 4, 2005
INVENTOR(S) : Yaw S. Obeng

It is certified that error appears in the above-identified patent and that said Letters Patent is hereby corrected as shown below:

Column 9,
Lines 33-47, should appear as follows:
-- FIGS. 2A-2C illustrate sectional views of selected steps in yet another embodiment of the present invention, a method of manufacturing a chemical mechanical polishing pad 200. As shown in FIG. 2A the method comprises providing a thermoplastic foam polishing body 205. As shown in FIG. 2B, the method also includes laminating a thermoplastic backing film 210 to the thermoplastic foam polishing body 205. Laminating is achieved via chemical bonding using conventional adhesives 207, such as epoxy or other materials well known to those skilled in the art, or pressure sensitive adhesives 207 such as a dual sided material, both sides being acrylic based adhesive. In other preferred embodiments laminating is achieved via extrusion coating of the molten backing film material onto the foam, while in still other embodiments the backing film 210 is thermally welded to the thermoplastic foam polishing body 205. --

Signed and Sealed this

Tenth Day of May, 2005

JON W. DUDAS
*Director of the United States Patent and Trademark Office*